US006293659B1

(12) United States Patent
Floyd et al.

(10) Patent No.: US 6,293,659 B1
(45) Date of Patent: Sep. 25, 2001

(54) PARTICULATE SOURCE, CIRCULATION, AND VALVING SYSTEM FOR BALLISTIC AEROSOL MARKING

(75) Inventors: Philip D. Floyd, Sunnyvale; David K. Biegelsen, Portola Valley; Eric Peeters, Fremont; Frederick J. Endicott, San Carlos, all of CA (US); Richard P. N. Veregin, Mississauga (CA); Gregory B. Anderson, Woodside, CA (US); Karen A. Moffat, Brantford; Maria N. V McDougall, Burlington, both of (CA); Jaan Noolandi; Armin R. Volkel, both of Mississauga (CA); Tuan Anh Vo, Hawthorne; Kaiser H. Wong, Torrance, both of CA (US); Peter M. Kazmaier, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/476,010

(22) Filed: Dec. 29, 1999

Related U.S. Application Data

(60) Provisional application No. 60/157,098, filed on Sep. 30, 1999.

(51) Int. Cl.[7] ..... B41J 2/175

(52) U.S. Cl. ..... 347/85

(58) Field of Search ..... 347/85, 86, 87, 347/83, 7, 21, 65, 68, 70

(56) References Cited

U.S. PATENT DOCUMENTS

| | | | |
|---|---|---|---|
| 2,573,143 | 10/1951 | Jacob | 178/5.2 |
| 2,577,894 | 12/1951 | Jacob | 346/75 |

(List continued on next page.)

FOREIGN PATENT DOCUMENTS

| | | |
|---|---|---|
| 0 655 337 A2 | 5/1995 | (EP) . |
| 0 726 158 A1 | 8/1996 | (EP) . |
| 353035539A | 4/1978 | (JP) . |

(List continued on next page.)

OTHER PUBLICATIONS

U. S. Application No. 09/164,124 (Attorney Docket D/98314Q1) entitled "Method of Marking a Subtrate Employing a Ballistic Aerosol Marking Apparatus" to Eric Peeters et al., filed Sep. 30, 1998.

U. S. Application No. 09/163,839 (Attorney Docket D/98409) entitled "Marking Material Transport" to Tuan Anh Vo et al., filed Sep. 30, 1998.

U. S. Application No. 09/163,954 (Attorney Docket D/98562) entitled Ballistic Aerosol Marking Apparatus for Marking with a Liquid Material to Eric Peeters et al., filed Sep. 30, 1998.

U. S. Application No. 09/163,518 (Attorney Docket No. D/98577) entitled "Inorganic Overcoat for Particulate Transport Electrode Grid" to Kaiser H. Wong et al., filed Sep. 30, 1998.

U. S. Application No. 09/163,664 (Attorney Docket No. D/98566) entitled "Organic Overcoat for Electrode Grid" to Kaiser H. Wong et al., filed Sep. 30, 1998.

(List continued on next page.)

*Primary Examiner*—Anh T. W. Vo

(57) ABSTRACT

A ballistic aerosol marking device includes, marking material which flows from a material reservoir to a delivery channel via a port. Flow of marking material is facilitated by the creation of a fluidized bed or aerosol of marking material in the reservoir. Gas flow together with mechanical or electromechanical assistance can be used to assist in the generation of the fluidized bed or aerosol.

16 Claims, 11 Drawing Sheets

U.S. PATENT DOCUMENTS

| | | | | |
|---|---|---|---|---|
| 3,152,858 | | 10/1964 | Wadey | 346/75 |
| 3,572,591 | | 3/1971 | Brown | 239/337 |
| 3,977,323 | | 8/1976 | Pressman et al. | 101/426 |
| 3,997,113 | | 12/1976 | Pennebaker, Jr. | 239/15 |
| 4,019,188 | | 4/1977 | Hochberg et al. | 346/75 |
| 4,106,032 | | 8/1978 | Miura et al. | 347/21 |
| 4,113,598 | | 9/1978 | Jozwiak, Jr. et al. | 204/181 R |
| 4,146,900 | | 3/1979 | Arnold | 346/75 |
| 4,171,777 | | 10/1979 | Behr | 239/422 |
| 4,189,937 | | 2/1980 | Nelson | 73/28 |
| 4,196,437 | | 4/1980 | Hertz | 347/98 |
| 4,223,324 | | 9/1980 | Yamamori et al. | 347/21 |
| 4,265,990 | | 5/1981 | Stolka et al. | 430/59 |
| 4,271,100 | | 6/1981 | Trassy | 261/78 A |
| 4,284,418 | | 8/1981 | Andres | 55/16 |
| 4,368,850 | | 1/1983 | Szekely | 239/333 |
| 4,403,228 | | 9/1983 | Miura et al. | 346/75 |
| 4,403,234 | | 9/1983 | Miura et al. | 347/21 |
| 4,480,259 | | 10/1984 | Kruger et al. | 347/63 |
| 4,490,728 | | 12/1984 | Vaught et al. | 347/60 |
| 4,500,895 | | 2/1985 | Buck et al. | 347/87 |
| 4,514,742 | * | 4/1985 | Suga et al. | 347/85 |
| 4,515,105 | | 5/1985 | Danta et al. | 118/629 |
| 4,523,202 | | 6/1985 | Gamblin | 346/75 |
| 4,544,617 | | 10/1985 | Mort et al. | 430/58 |
| 4,606,501 | | 8/1986 | Bate et al. | 239/346 |
| 4,607,267 | | 8/1986 | Yamamuro | 347/51 |
| 4,613,875 | | 9/1986 | Le et al. | 347/21 |
| 4,614,953 | | 9/1986 | Lapeyre | 347/43 |
| 4,634,647 | | 1/1987 | Jansen et al. | 430/84 |
| 4,647,179 | | 3/1987 | Schmidlin | 355/3 DD |
| 4,663,258 | | 5/1987 | Pai et al. | 430/57 |
| 4,666,806 | | 5/1987 | Pai et al. | 430/57 |
| 4,683,481 | | 7/1987 | Johnson | 374/65 |
| 4,720,444 | | 1/1988 | Chen | 430/58 |
| 4,728,969 | | 3/1988 | Le et al. | 347/21 |
| 4,741,930 | | 5/1988 | Howard et al. | 427/265 |
| 4,760,005 | | 7/1988 | Pai | 430/65 |
| 4,770,963 | | 9/1988 | Pai et al. | 430/64 |
| 4,771,295 | * | 9/1988 | Baker et al. | 347/86 |
| 4,839,232 | | 6/1989 | Morita et al. | 428/473.5 |
| 4,839,666 | | 6/1989 | Jayne | 346/75 |
| 4,870,430 | | 9/1989 | Daggett et al. | 347/88 |
| 4,882,245 | | 11/1989 | Gelorme et al. | 430/14 |
| 4,896,174 | | 1/1990 | Stearns | 346/459 |
| 4,929,968 | | 5/1990 | Ishikawa | 347/21 |
| 4,961,966 | | 10/1990 | Stevens et al. | 427/299 |
| 4,973,379 | | 11/1990 | Brock et al. | 156/640 |
| 4,982,200 | | 1/1991 | Ramsay | 346/75 |
| 5,030,536 | | 7/1991 | Pai et al. | 430/127 |
| 5,041,849 | | 8/1991 | Quate et al. | 347/46 |
| 5,045,870 | | 9/1991 | Lamey et al. | 347/59 |
| 5,063,655 | | 11/1991 | Lamey et al. | 29/611 |
| 5,066,512 | | 11/1991 | Goldowsky et al. | 427/14.1 |
| 5,113,198 | | 5/1992 | Nishikawa et al. | 347/21 |
| 5,190,817 | | 3/1993 | Terrell et al. | 428/343 |
| 5,202,704 | | 4/1993 | Iwao | 347/55 |
| 5,208,630 | | 5/1993 | Goodbrand et al. | 355/201 |
| 5,209,998 | | 5/1993 | Kavassalis et al. | 430/106 |
| 5,240,153 | | 8/1993 | Tubaki et al. | 222/385 |
| 5,240,842 | | 8/1993 | Mets | 435/172.3 |
| 5,294,946 | | 3/1994 | Gandy et al. | 347/3 |
| 5,300,339 | | 4/1994 | Hays et al. | 428/36.9 |
| 5,350,616 | | 9/1994 | Pan et al. | 428/131 |
| 5,363,131 | | 11/1994 | Momose et al. | 347/46 |
| 5,385,803 | | 1/1995 | Duff et al. | 430/138 |
| 5,403,617 | | 4/1995 | Haaland | 427/180 |
| 5,425,802 | | 6/1995 | Burton et al. | 95/32 |
| 5,426,458 | | 6/1995 | Wenzel et al. | 347/45 |
| 5,428,381 | | 6/1995 | Hadimioglu et al. | 347/46 |
| 5,482,587 | | 1/1996 | McAleavey | 156/243 |
| 5,510,817 | | 4/1996 | Sohn | 347/21 |
| 5,512,712 | | 4/1996 | Iwata et al. | 174/258 |
| 5,520,715 | | 5/1996 | Oeftering | 75/335 |
| 5,522,555 | | 6/1996 | Poole | 241/33 |
| 5,535,494 | | 7/1996 | Plesinger et al. | 29/25.35 |
| 5,541,625 | | 7/1996 | Holstun et al. | 347/5 |
| 5,554,480 | | 9/1996 | Patel et al. | 430/137 |
| 5,600,351 | | 2/1997 | Holstun et al. | 347/40 |
| 5,604,519 | | 2/1997 | Keefe et al. | 347/13 |
| 5,635,969 | | 6/1997 | Allen | 347/96 |
| 5,640,187 | | 6/1997 | Kashiwazaki et al. | 347/101 |
| 5,646,656 | | 7/1997 | Leonhardt et al. | 347/43 |
| 5,654,744 | | 8/1997 | Nicoloff, Jr. et al. | 347/43 |
| 5,678,133 | | 10/1997 | Siegel | 399/67 |
| 5,682,190 | | 10/1997 | Hirosawa et al. | 347/94 |
| 5,712,669 | | 1/1998 | Swanson et al. | 347/49 |
| 5,717,986 | | 2/1998 | Vo et al. | 399/291 |
| 5,731,048 | | 3/1998 | Ashe et al. | 427/585 |
| 5,756,190 | | 5/1998 | Hosomi et al. | 428/209 |
| 5,761,783 | | 6/1998 | Osawa et al. | 29/25.35 |
| 5,777,636 | | 7/1998 | Naganuma et al. | 347/10 |
| 5,787,558 | | 8/1998 | Murphy | 29/25.35 |
| 5,818,477 | | 10/1998 | Fullmer et al. | 347/43 |
| 5,828,388 | | 10/1998 | Cleary et al. | 347/21 |
| 5,853,906 | | 12/1998 | Hsieh | 428/690 |
| 5,882,830 | | 3/1999 | Visser et al. | 430/59 |
| 5,893,015 | | 4/1999 | Mojarradi et al. | 399/291 |
| 5,900,898 | | 5/1999 | Shimizu et al. | 347/93 |
| 5,958,122 | | 9/1999 | Fukuda et al. | 106/31.57 |
| 5,967,044 | | 10/1999 | Marschke | 101/363 |
| 5,968,674 | | 10/1999 | Hsieh et al. | 428/690 |
| 5,969,733 | | 10/1999 | Sheinman | 347/75 |
| 5,981,043 | | 11/1999 | Murakami et al. | 428/209 |
| 5,982,404 | | 11/1999 | Iga et al. | 347/173 |
| 5,990,197 | | 11/1999 | Escano et al. | 523/160 |
| 5,992,978 | | 11/1999 | Fujii et al. | 347/54 |
| 6,019,466 | | 2/2000 | Hermanson | 347/104 |
| 6,036,295 | | 3/2000 | Ando et al. | 347/7 |
| 6,081,281 | | 6/2000 | Cleary et al. | 347/21 |
| 6,116,718 | | 9/2000 | Peeters et al. | 347/21 |

FOREIGN PATENT DOCUMENTS

| | | |
|---|---|---|
| 53035539 A | 4/1978 | (JP) . |
| 55 019556 | 2/1980 | (JP) . |
| 55 028819 | 2/1980 | (JP) . |
| 56 146773 | 11/1981 | (JP) . |
| 58-224760 | 12/1983 | (JP) . |
| 60 229764 | 11/1985 | (JP) . |
| 362035847A | 2/1987 | (JP) . |
| 02 293151 | 12/1990 | (JP) . |
| 4-158044 | 6/1992 | (JP) . |
| 4-182138 | 6/1992 | (JP) . |
| 5-4348 | 1/1993 | (JP) . |
| 5-193140 | 8/1993 | (JP) . |
| 5-269995 | 10/1993 | (JP) . |
| WO 93/11866 | 6/1993 | (WO) . |
| WO 94/18011 | 8/1994 | (WO) . |
| WO 97/01449 | 1/1997 | (WO) . |
| WO 97/27058 | 7/1997 | (WO) . |

OTHER PUBLICATIONS

U. S. Application No. 09/163,799 (Attorney Docket D/98565Q1) entitled "Method of Making a Print Head for Use in a Ballistic Aerosol Marking Apparatus" to Eric Peeters et al., filed Sep. 30, 1998.

U. S. Application No. 09/163,825 (Attorney Docket D/98563) entitled "Multi–Layer Organic Overcoat for Electrode Grid" to Kaiser H. Wong, filed Sep. 30, 1998.

U. S. Application No. 09/163,839 (Attorney Docket D/98314) entitled "Ballistic Aerosol Marking Apparatus for Marking a Substrate" to Tuan Anh Vo et al, filed Sep. 30, 1998.

U. S. Application No. 09/163,924 (Attorney Docket D/98562Q1) entitled "Method for Marking with a Liquid Material Using a Ballistic Aerosol Marking Apparatus" to Eric Peeters et al., filed Sep. 30, 1998.

U. S. Application No. 09/164,104 (Attorney Docket D/98564) "Kinetic Fusing of a Marking Material" to Jaan Noolandi et al., filed Sep. 30, 1998.

U.S. Application No. 09/163,765 (Attorney Docket D/98314Q4) entitled "Cartridge for Use in a Ballistic Aerosol Marking Apparatus" to Eric Peeters et al., filed Sep. 30, 1998.

U.S. Application No. 09/163,808 (Attorney Docket D/98314Q3) entitled "Method of Treating a Substrate Employing a Ballistic Aerosol Marking Apparatus" to Eric Peeters et al, filed Sep. 30, 1998.

U.S. Application No. 09/164,250 (Attorney Docket D/98314Q2) entitled "Ballistic Aerosol Marking Apparatus for Treating a Substrate" to.Eric Peeters et al., filed Sep. 30, 1998.

F. Anger, Jr. et al. Low Surface Energy Fluoro–Epoxy Coating For Drop–On–Demand Nozzles, *IBM Technical Disclosure Bulletin*, vol. 26, No. 1, p. 431, Jun. 1983.

N. A. Fuchs. The Mechanics of Aerosols, Dover Publications, Inc., p. 79, 367–377, 1989 (Originally published in 1964 by Pergamon Press Ltd.).

Hue Le et al. Air–Assisted Ink Jet With Mesa–Shaped Ink–Drop–Forming Orifice, Presented at the Fairmont Hotel in Chicago and San Jose, Fall 1987, p. 223–227.

No author listed, Array Printers Demonstrates First Color Printer Engine, The Hard Copy Observer Published by Lyra Research, Inc., vol. VIII, No. 4, p. 36, Apr. 1998.

U. S. Application No. 09/041,353, Coated Photographic Papers, Filed Mar. 12, 1998.

U. S. Application No. 09/410,371, Ballistic Aerosol Marking Apparatus With Non–Wetting Coating, Filed Sep. 30, 1999.

U. S. Application No. 09/407,908, Ballistic Aerosol Marking Apparatus With Stacked Electrode Structure, Filed Sep. 29, 1999.

* cited by examiner

PARTICULATE SOURCE, CIRCULATION, AND VALVING SYSTEM FOR BALLISTIC AEROSOL MARKING

This application claims the priority benefit of U.S. Provisional Application No. 60/157,098, filed Sep. 30, 1999, and hereby incorporates same by reference thereto.

CROSS-REFERENCE TO RELATED APPLICATIONS

The present invention is related to U.S. patent applications Ser. Nos. 09/163,893, 09/164,124, 09/164,250, 09/163,808, 09/163,765, 09/163,839, 09/163,954, 09/163,924, 09/163,904, 09/163,799, 09/163,664, 09/163,518, 09/164,104, 09/163,825, 08/128,160, 08/670,734, 08/950,300, and 08/950,303, and issued U.S. Pat. No. 5,717,986, each of the above being incorporated herein by reference.

BACKGROUND

The present invention relates generally to the field of marking devices, and more particularly to a device capable of applying a marking material to a substrate by introducing the marking material into a high-velocity propellant stream.

Ink jet is currently a common printing technology. There are a variety of types of ink jet printing, including thermal ink jet (TIJ), piezo-electric ink jet, etc. In general, liquid ink droplets are ejected from an orifice located at a one terminus of a channel. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. For a 300 spot-per-inch (spi) TIJ system, the exit orifice from which an ink droplet is ejected is typically on the order of about 64 $\mu$m in width, with a channel-to-channel spacing (pitch) of about 84 $\mu$m, and for a 600 dpi system width is about 35 $\mu$m and pitch of about 42 $\mu$m. A limit on the size of the exit orifice is imposed by the viscosity of the fluid ink used by these systems. It is possible to lower the viscosity of the ink by diluting it in increasing amounts of liquid (e.g., water) with an aim to reducing the exit orifice width. However, the increased liquid content of the ink results in increased wicking, paper wrinkle, and slower drying time of the ejected ink droplet, which negatively affects resolution, image quality (e.g., minimum spot size, inter-color mixing, spot shape), etc. The effect of this orifice width limitation is to limit resolution of TIJ printing, for example to well below 900 spi, because spot size is a function of the width of the exit orifice, and resolution is a function of spot size.

Another disadvantage of known ink jet technologies is the difficulty of producing greyscale printing. That is, it is very difficult for an ink jet system to produce varying size spots on a printed substrate. If one lowers the propulsive force (heat in a TIJ system) so as to eject less ink in an attempt to produce a smaller dot, or likewise increases the propulsive force to eject more ink and thereby to produce a larger dot, the trajectory of the ejected droplet is affected. This in turn renders precise dot placement difficult or impossible, and not only makes monochrome greyscale printing problematic, it makes multiple color greyscale ink jet printing impracticable. In addition, preferred greyscale printing is obtained not by varying the dot size, as is the case for TIJ, but by varying the dot density while keeping a constant dot size.

Still another disadvantage of common ink jet systems is rate of marking obtained. Approximately 80% of the time required to print a spot is taken by waiting for the ink jet channel to refill with ink by capillary action. To a certain degree, a more dilute ink flows faster, but raises the problem of wicking, substrate wrinkle, drying time, etc. discussed above.

One problem common to ejection printing systems is that the channels may become clogged. Systems such as TIJ which employ aqueous ink colorants are often sensitive to this problem, and routinely employ non-printing cycles for channel cleaning during operation. This is required since ink typically sits in an ejector waiting to be ejected during operation, and while sitting may begin to dry and lead to clogging.

Other technologies which may be relevant as background to the present invention include electrostatic grids, electrostatic ejection (so-called tone jet), acoustic ink printing, and certain aerosol and atomizing systems such as dye sublimation.

SUMMARY

The present invention is employed in a novel system for applying a marking material to a substrate, directly or indirectly, which overcomes the disadvantages referred to above, as well as others discussed further herein. Ballistic aerosol marking apparatus and processes have been described in the aforementioned and incorporated U.S. patent applications, such as 09/163,893. In such an apparatus, a propellant is caused to flow through a channel, and marking material is selectively delivered to the channel whereby it is imparted with sufficient kinetic energy by the propellant stream to impact a substrate. A relatively large number of such channels may be employed to form a print head. Also, a multiplicity of marking materials may be delivered to the channels concurrently, whereby they are mixed in said channels prior to impacting the substrate. Single-pass color printing is one possible benefit obtained from this architecture.

In particular, however, the present invention relates to methods and apparatus for generating and supplying particulates to the channel for a ballistic aerosol marking print head. The particles are generated in an aerosol form above a bed of particulates, excited by gas flow and sonic or ultrasonic vibration, or by mechanical/gas excitation with a rotating mechanical arm, such as a propeller. Additionally particles can be supplied in a liquid form (loosely packed, readily flowing) to the channels by a sonic/ultrasonic vibration and gas flow.

The propellant is usually a dry gas which may continuously flow through the channel while the marking apparatus is in an operative configuration (i.e., in a power-on or similar state ready to mark). The system is referred to as "ballistic aerosol marking" in the sense that marking is achieved by in essence launching a non-colloidal, solid or semi-solid particulate, or alternatively a liquid, marking material at a substrate. The shape of the channel may result in a collimated (or focused) flight of the propellant and marking material onto the substrate.

In our system, the propellant may be introduced at a propellant port into the channel to form a propellant stream. A marking material may then be introduced into the propellant stream from one or more marking material inlet ports. The propellant may enter the channel at a high velocity. Attentively, the propellant may be introduced into the channel at a high pressure, and the channel may include a constriction (e.g., de Laval or similar converging/diverging type nozzle) for converting the high pressure of the propellant to high velocity. In such a case, the propellant is introduced at a port located at a proximal end of the channel (defined as the converging region), and the marking material ports are provided near the distal end of the channel (at or further down-stream of a region defined as the diverging region), allowing for introduction of marking material into the propellant stream.

In the case where multiple ports are provided, each port may provide for a different color (e.g., cyan, magenta, yellow, and black), pre-marking treatment material (such as a marking material adherent), post-marking treatment material (such as a substrate surface finish material, e.g., matte or gloss coating, etc.), marking material not otherwise visible to the unaided eye (e.g., magnetic particle-bearing material, ultra violet-fluorescent material, etc.) or other marking material to be applied to the substrate. The marking material is imparted with kinetic energy from the propellant stream, and ejected from the channel at an exit orifice located at the distal end of the channel in a direction toward a substrate.

One or more such channels may be provided in a structure which, in one embodiment, is referred to herein as a print head. The width of the exit (or ejection) orifice of a channel is generally on the order of 250 $\mu$m or smaller, preferably in the range of 100 $\mu$m or smaller. Where more than one channel is provided, the pitch, or spacing from edge to edge (or center to center) between adjacent channels may also be on the order of 250 $\mu$m or smaller, preferably in the range of 100 $\mu$m or smaller. Alternatively, the channels may be staggered, allowing reduced edge-to-edge spacing.

The material to be applied to the substrate may be transported to a port by one or more of a wide variety of ways, including simple gravity feed, hydrodynamic, electrostatic, or ultrasonic transport, etc. The material may be metered out of the port into the propellant stream also by one of a wide variety of ways, including control of the transport mechanism, or a separate system such as pressure balancing, electrostatics, acoustic energy, ink jet, etc.

The material to be applied to the substrate may be a solid or semi-solid particulate material such as a toner or variety of toners in different colors, a suspension of such a marking material in a carrier, a suspension of such a marking material in a carrier with a charge director, a phase change material, etc., both visible and non-visible. One preferred embodiment employs a marking material which is particulate, solid or semi-solid, and dry or suspended in a liquid carrier. Such a marking material is referred to herein as a particulate marking material. This is to be distinguished from a liquid marking material, dissolved marking material, atomized marking material, or similar non-particulate material, which is generally referred to herein as a liquid marking material. However, the present invention is able to utilize such a liquid marking material in certain applications, as otherwise described herein. Indeed, the present invention may also be employed in the use of non-marking materials, such as marking pre- and post-treatments, finishes, curing or sealing materials, etc., and accordingly the present disclosure and claims should be read to broadly encompass the transport and marking of wide variety of materials.

Thus, the present invention and its various embodiments provide numerous advantages discussed above, as well as additional advantages which will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as pressures, velocities, widths, lengths, etc. These recited ranges are to be treated as examples only, and are not intended to limit the scope of the claims hereof. In addition, a number of materials are identified as suitable for various facets of the embodiments, such as for marking materials, propellants, body structures, etc. These recited materials are also to be treated as exemplary, and are not intended to limit the scope of the claims hereof.

Figure 1:
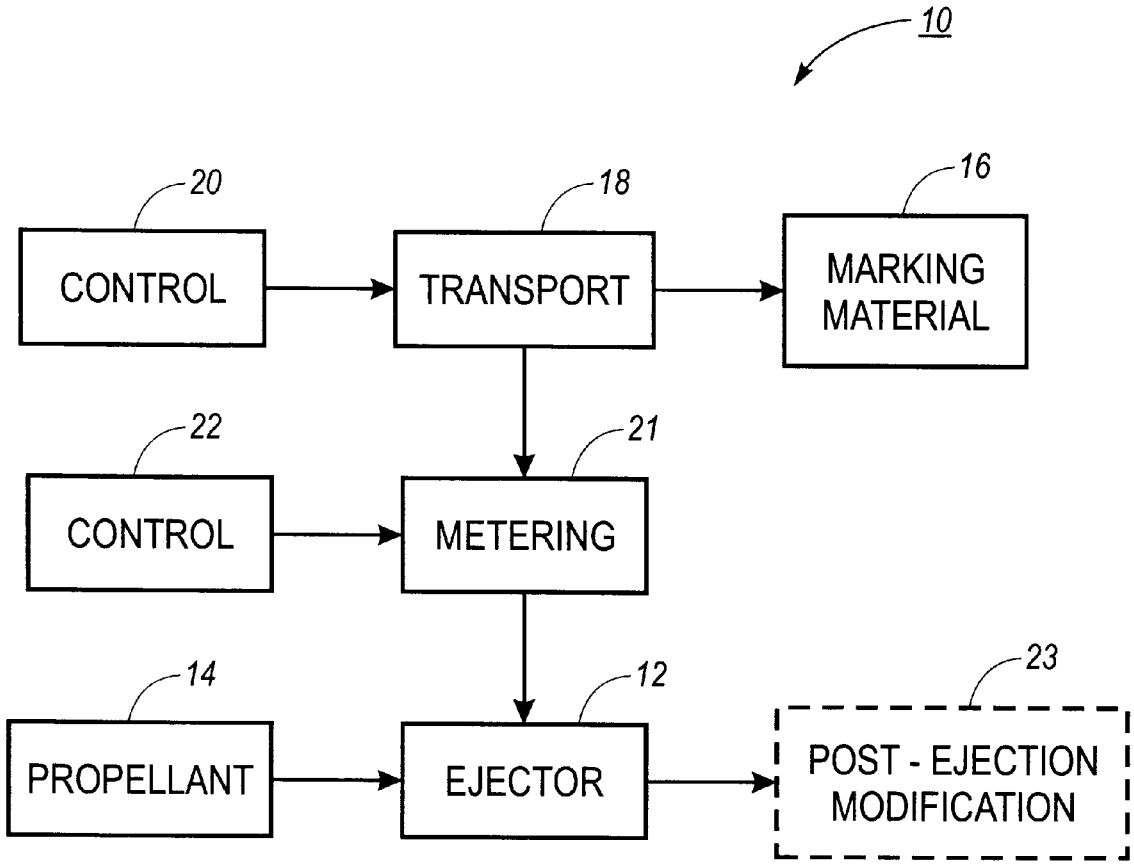
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 consists of one or more ejectors 12 to which a propellant 14 is fed. A marking material 16, which may be transported by a transport 18 under the control of control 20 is introduced into ejector 12. (Optional elements are indicated by dashed lines.) The marking material is metered (that is controllably introduced) into the ejector by metering means 21, under control of control 22. The marking material ejected by ejector 12 may be subject to post ejection modification 23, optionally also part of device 10. It will be appreciated that device 10 may form a part of a printer, for example of the type commonly attached to a computer network, personal computer or the like, part of a facsimile machine, part of a document duplicator, part of a labeling apparatus, or part of any other of a wide variety of marking devices.

Figure 2:
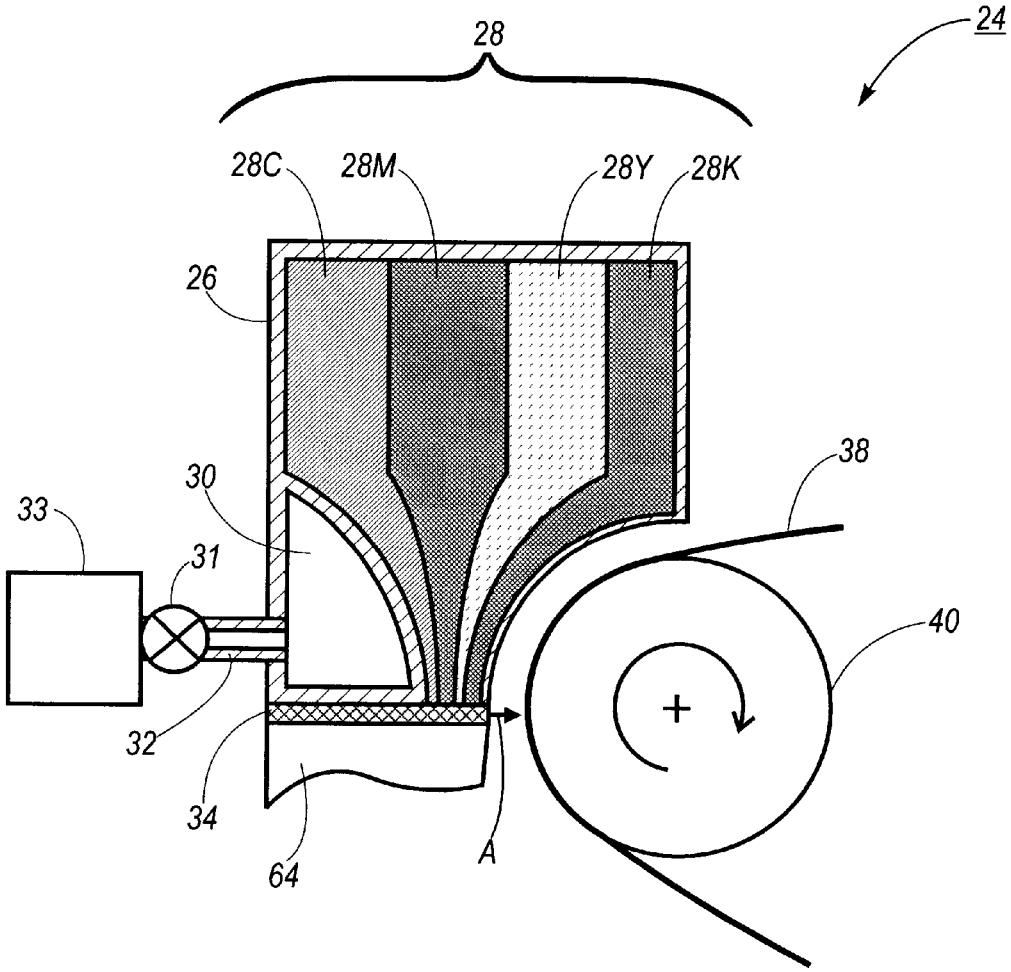
FIG. 2 is cross sectional illustration of a marking apparatus according to one embodiment of the present invention.

The embodiment illustrated in FIG. 1 may be realized by a ballistic aerosol marking device 24 of the type shown in the cut-away side view of FIG. 2. According to this embodiment, the materials to be deposited will be 4 colored toners, for example cyan (C), magenta (M), yellow (Y), and black (K), of a type described further herein, which may be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials such as materials creating a surface for adhering marking material particles (or other substrate surface pre-treatment), a desired substrate finish quality (such as a matte, satin or gloss finish or other substrate surface post-treatment), material not visible to the unaided eye (such as magnetic particles, ultra violet-fluorescent particles, etc.) or other material associated with a marked substrate, is clearly contemplated herein.

Device 24 consists of a body 26 within which is formed a plurality of cavities 28C, 28M, 28Y, and 28K (collectively referred to as cavities 28) for receiving materials to be deposited. Also formed in body 26 may be a propellant cavity 30. A fitting 32 may be provided for connecting propellant cavity 30 to a propellant source 33 such as a compressor, a propellant reservoir, or the like. Body 26 may be connected to a print head 34, comprised of among other layers, substrate 36 and channel layer 37 that will be discussed later.

Figure 3:
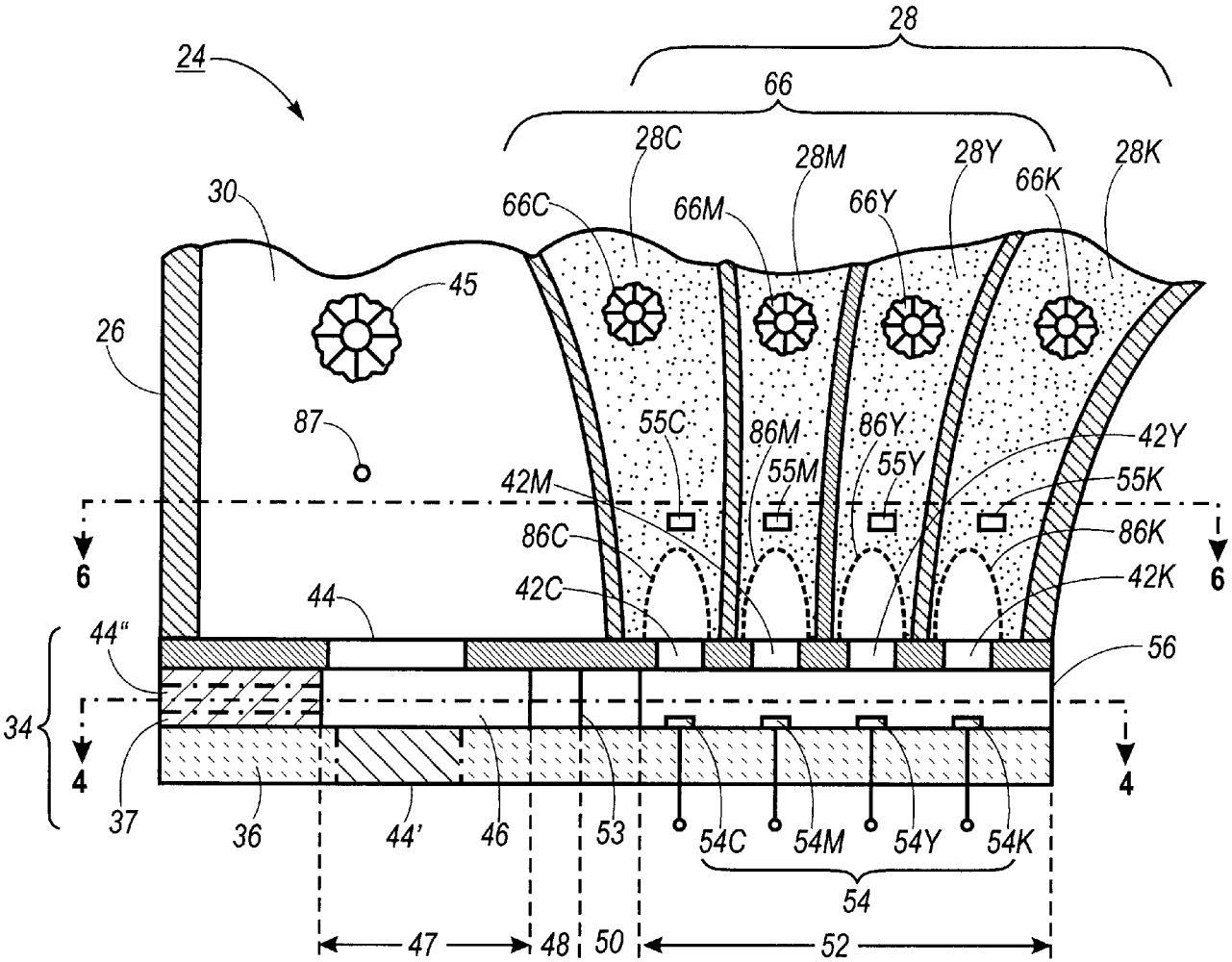
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular or other cross-section, providing communication between said cavities and a channel 46 which adjoins body 26. Ports 42 are shown having a longitudinal axis roughly perpendicular to the longitudinal axis of channel 46. However, the angle between the longitudinal axes of ports 42 and channel 46 may be other than 90 degrees, as appropriate for the particular application of the present invention.

Likewise, propellant cavity 30 includes a port 44, of circular, oval, rectangular or other cross-section, between said cavity and channel 46 through which propellant may travel. Alternatively, print head 34 may be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. We have experimentally demonstrated a propellant marking material flow pattern from a print head employing a number of the features described herein which remains relatively collimated for a distance of up to 10 millimeters, with an optimal printing spacing on the order of between one and several millimeters. For example, the print head produces a marking material stream which does not deviate by more than between 20 percent, and preferably by not more than 10 percent, from the width of the exit orifice for a distance of at least 4 times the exit orifice width. However, the appropriate spacing between the print head and the substrate is a function of many parameters, and does not itself form a part of the present invention.

Referring again to FIG. 3, according to one embodiment of the present invention, print head 34 consists of a substrate 36 and channel layer 37 in which is formed channel 46. Additional layers, such as an insulating layer, capping layer, etc. (not shown) may also form a part of print head 34. Substrate 36 is formed of a suitable material such as glass, ceramic, etc., on which (directly or indirectly) is formed a relatively thick material, such as a thick permanent photoresist (e.g., a liquid photosensitive epoxy such as SU-8, from Microlithography Chemicals, Inc; see also U.S. Pat. No. 4,882,245) and/or a dry film-based photoresist such as the Riston photopolymer resist series, available from DuPont Printed Circuit Materials, Research Triangle Park, N.C. (see, www.dupont.com/pcm/) which may be etched, machined, or otherwise in which may be formed a channel with features described below.

Figure 4:
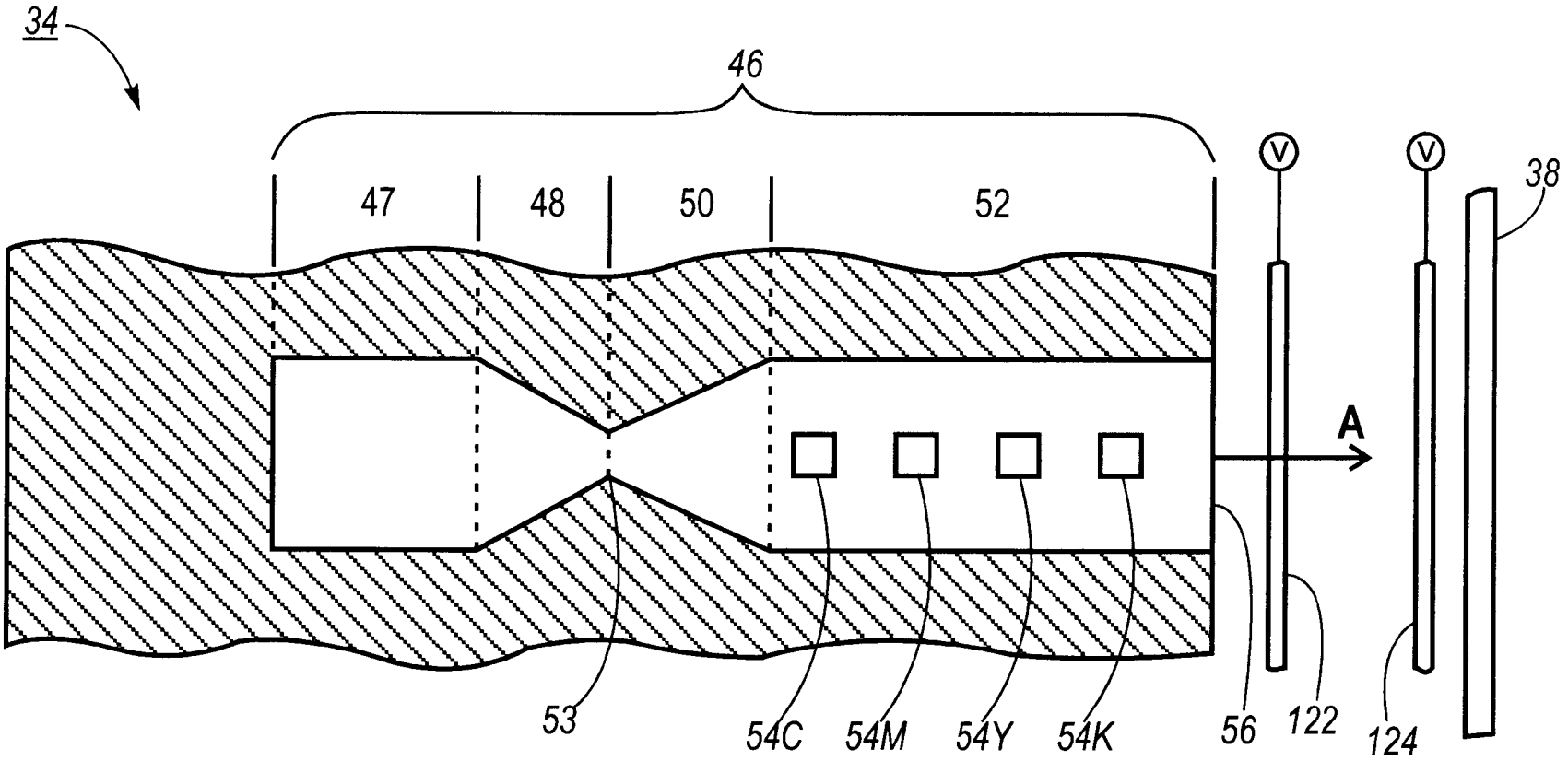
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe. An exit orifice 56 is located at the distal end of channel 46.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant may continuously flow through the channel while the marking apparatus is in an operative configuration (e.g., a "power on" or similar state ready to mark), or may be modulated such that propellant passes through the channel only when marking material is to be ejected, as dictated by the particular application of the present invention. Such propellant modulation may be accomplished by a valve 31 interposed between the propellant source 33 and the channel 46, by modulating the generation of the propellant for example by turning on and off a compressor or selectively initiating a chemical reaction designed to generate propellant, or by other means not shown.

Marking material may controllably enter the channel through one or more ports 42 located in the marking material injection region 52. That is, during use, the amount of marking material introduced into the propellant stream may be controlled from zero to a maximum per spot. The propellant and marking material travel from the proximal end to a distal end of channel 46 at which is located exit orifice 56.

Figure 5A:
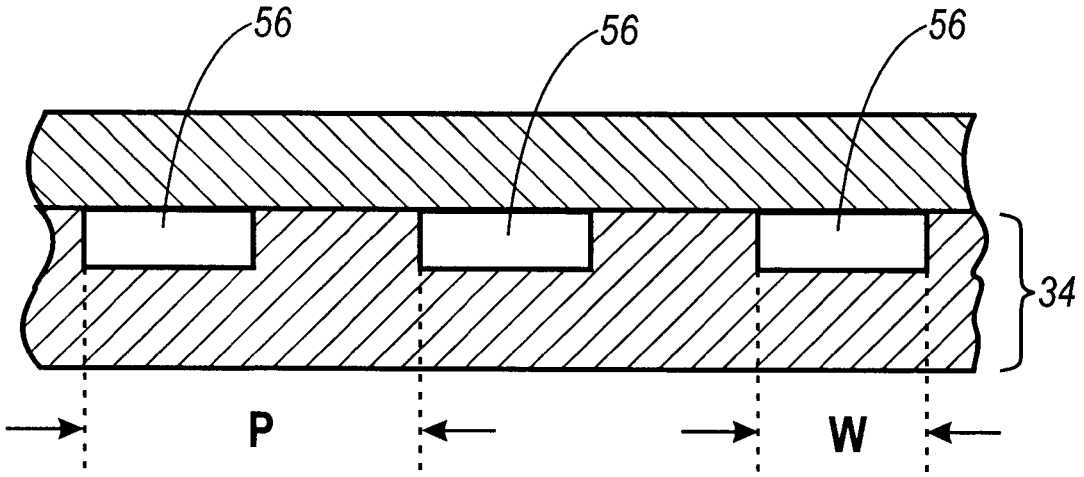
FIGS. 5A and 5B are end views of non-staggered and two-dimensionally staggered arrays of channels according to the present invention.
Figure 5B:
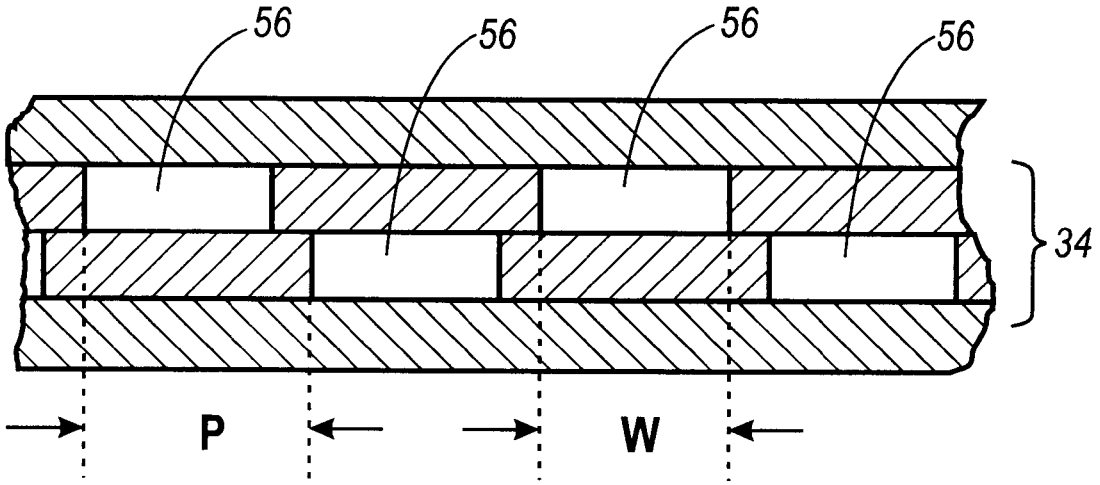

While FIG. 4 illustrates a print head 34 having one channel therein, it will be appreciated that a print head according to the present invention may have an arbitrary number of channels, and range from several hundred micrometers across with one or several channels, to a page-width (e.g., 8.5 or more inches across) with thousands of channels. The width W of each exit orifice 56 may be on the order of 250 $\mu$m or smaller, preferably in the range of 100 $\mu$m or smaller. The pitch P, or spacing from edge to edge (or center to center) between adjacent exit orifices 56 may also be on the order of 250 $\mu$m or smaller, preferably in the range of 100 $\mu$m or smaller in non-staggered array, illustrated in end view in FIG. 5A. In a two-dimensionally staggered array, of the type shown in FIG. 5B, the pitch may be further reduced. For example, Table 1 illustrates typical pitch and width dimensions for different resolutions of a non-staggered array.

TABLE 1

| Resolution | Pitch | Width |
|---|---|---|
| 300 | 84 | 60 |
| 600 | 42 | 30 |
| 900 | 32 | 22 |
| 1200 | 21 | 15 |

Figure 6:
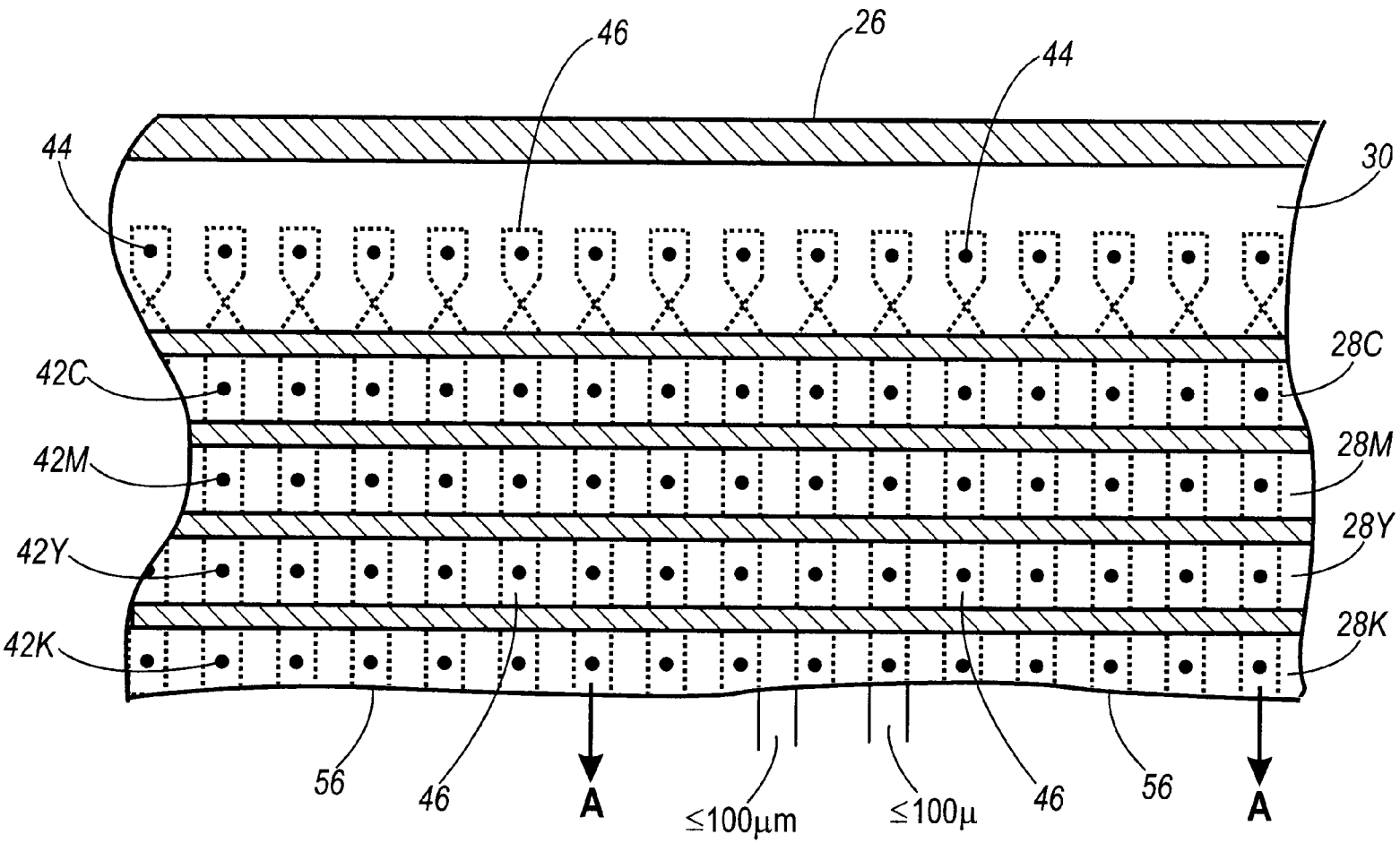
FIG. 6 is plan view of an array of channels of an apparatus according to one embodiment of the present invention.
Figure 7A:
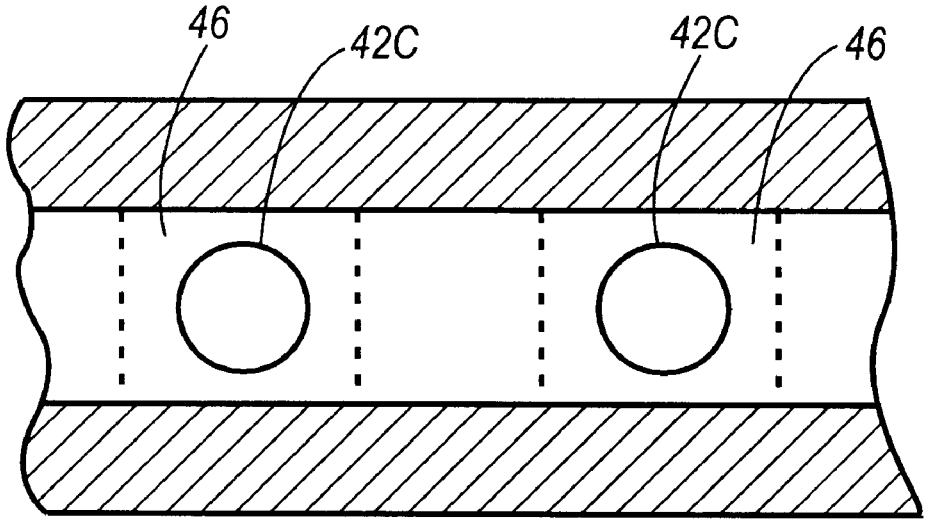
FIGS. 7A and 7B are plan views of a portion of the array of channels shown in FIG. 6, illustrating two embodiments of ports according to the present invention.
Figure 7B:
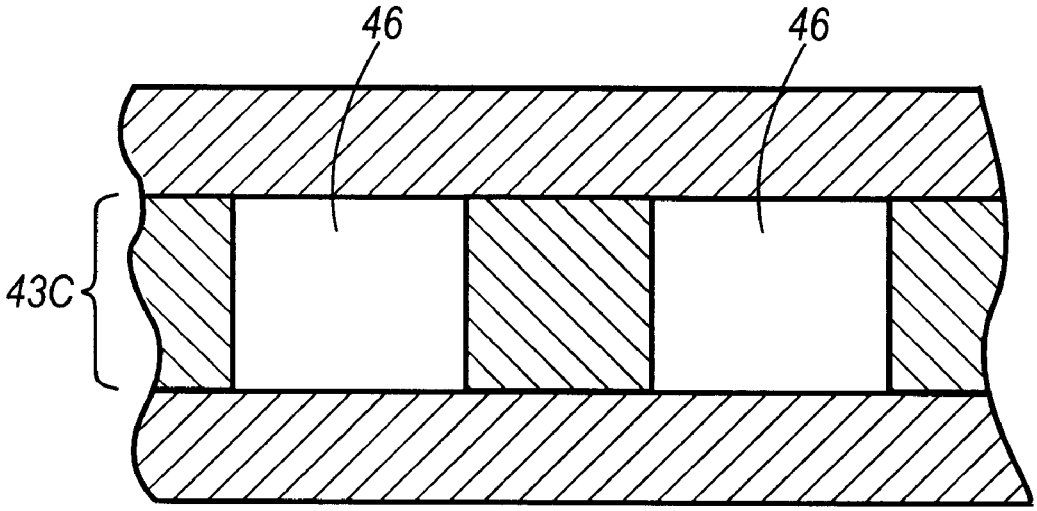

As illustrated in FIG. 6, a wide array of channels in a print head may be provided with marking material by continuous cavities 28, with ports 42 associated with each channel 46. Likewise, a continuous propellant cavity 30 may service each channel 46 through an associated port 44. Ports 42 may be discrete openings in the cavities, as illustrated in FIG. 7A, or may be formed by a continuous opening 43 (illustrated by one such opening 43C) extending across the entire array, as illustrated in FIG. 7B.

Device Operation

Figure 8:
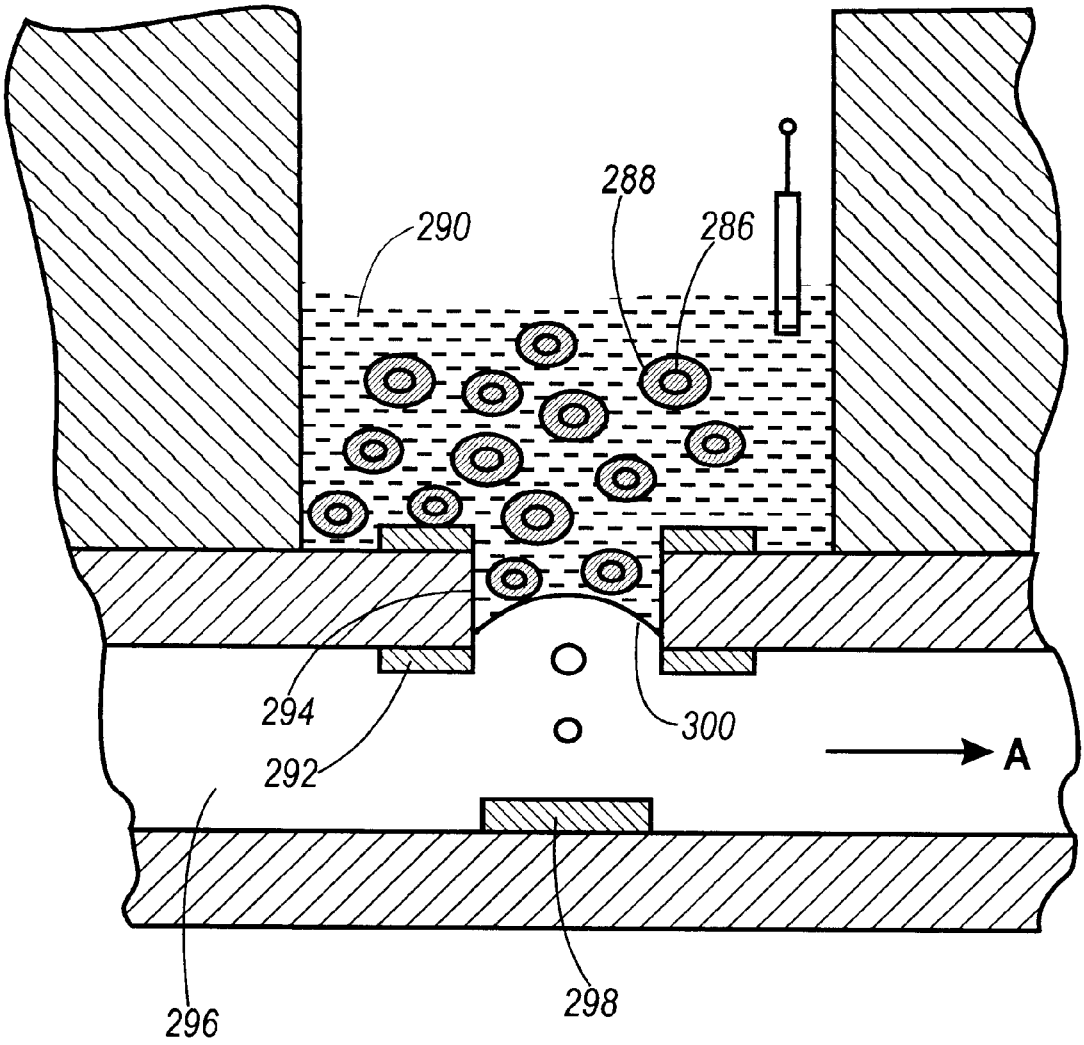
FIG. 8 is a process flow diagram for the marking of a substrate according to the present invention.

The process 70 involved in the marking of a substrate with marking material according to the present invention is illustrated by the steps shown in FIG. 8. According to step 72, a propellant is provided to a channel. A marking material is next metered into the channel at step 74. In the event that the channel is to provide multiple marking materials to the substrate, the marking materials may be mixed in the channel at step 76 so as to provide a marking material mixture to the substrate. By this process, one-pass color marking, without the need for color registration, may be obtained. An alternative for one-pass color marking is the sequential introduction of multiple marking materials while maintaining a constant registration between print head 34 and substrate 38. Since, not every marking will be composed of multiple marking materials, this step is optional as represented by the dashed arrow 78. At step 80, the marking material is ejected from an exit orifice at a distal end of the channel, in a direction toward, and with sufficient energy to reach a substrate. The process may be repeated with reregistering the print head, as indicated by arrow 83. Appropriate post ejection treatment, such as fusing, drying, etc. of the marking material is performed at step 82, again optional as indicated by the dashed arrow 84.

Marking Material

According to one embodiment of the present invention a solid, particulate marking material is employed for marking a substrate. The marking material particles may be on the order of 0.5 to 10.0 $\mu$m, preferably in the range of 1 to 5 $\mu$m, although sizes outside of these ranges may function in specific applications (e.g., larger or smaller ports and channels through which the particles must travel).

There are several advantages provided by the use of solid, particulate marking material. First, clogging of the channel is minimized as compared, for example, to liquid inks. Second, wicking and running of the marking material (or its carrier) upon the substrate, as well as marking material/substrate interaction may be reduced or eliminated. Third, spot position problems encountered with liquid marking material caused by surface tension effects at the exit orifice are eliminated. Fourth, channels blocked by gas bubbles retained by surface tension are eliminated. Fifth, multiple marking materials (e.g., multiple colored toners) can be mixed upon introduction into a channel for single pass multiple material (e.g., multiple color) marking, without the risk of contaminating the channel for subsequent markings (e.g., pixels). Registration overhead (equipment, time, related print artifacts, etc.) is thereby eliminated. Sixth, the channel refill portion of the duty cycle (up to 80% of a TIJ duty cycle) is eliminated. Seventh, there is no need to limit the substrate throughput rate based on the need to allow a liquid marking material to dry.

However, despite any advantage of a dry, particulate marking material, there may be some applications where the use of a liquid marking material, or a combination of liquid and dry marking materials, may be beneficial. In such instances, the present invention may be employed, with simply a substitution of the liquid marking material for the solid marking material and appropriate process and device changes apparent to one skilled in the art or described herein, for example substitution of metering devices, etc.

In certain applications of the present invention, it may be desirable to apply a substrate surface pre-marking treatment. For example, in order to assist with the fusing of particulate marking material in the desired spot locations, it may be beneficial to first coat the substrate surface with an adherent layer tailored to retain the particulate marking material. Examples of such material include clear and/or colorless polymeric materials such as homopolymers, random copolymers or block copolymers that are applied to the substrate as a polymeric solution where the polymer is dissolved in a low boiling point solvent. The adherent layer is applied to the substrate ranging from 1 to 10 microns in thickness or preferably from about 5 to 10 microns thick. Examples of such materials are polyester resins either linear or branched, poly(styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates and mixtures thereof and the like. This surface pre-treatment may be applied from channels of the type described herein located at the leading edge of a print head, and may thereby apply both the pre-treatment and the marking material in a single pass. Alternatively, the entire substrate may be coated with the pre-treatment material, then marked as otherwise described herein. See U.S. patent application Ser. No. 08/041,353, incorporated herein by reference. Furthermore, in certain applications it may be desirable to apply marking material and pre-treatment material simultaneously, such as by mixing the materials in flight, as described further herein.

Likewise, in certain applications of the present invention, it may be desirable to apply a substrate surface post-marking treatment. For example, it may be desirable to provide some or all of the marked substrate with a gloss finish. In one example, a substrate is provided with marking comprising both text and illustration, as otherwise described herein, and it is desired to selectively apply a gloss finish to the illustration region of the marked substrate, but not the text region. This may be accomplished by applying the post-marking treatment from channels at the trailing edge of the print head, to thereby allow for one-pass marking and post-marking treatment. Attentively, the entire substrate may be marked as appropriate, then passed through a marking device according to the present invention for applying the post-marking treatment. Furthermore, in certain applications it may be desirable to apply marking material and post-treatment material simultaneously, such as by mixing the materials in flight, as described further herein. Examples of materials for obtaining a desired surface finish include polyester resins either linear or branched, poly(styrenic) homopolymers, poly(acrylate) and poly(methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates, and mixtures thereof and the like.

Other pre- and post-marking treatments include the underwriting/overwriting of markings with marking material not visible to the unaided eye, document tamper protection coatings, security encoding, for example with wavelength specific dyes or pigments that can only be detected at a specific wavelength (e.g., in the infrared or ultraviolet range) by a special decoder, and the like. See U.S. Pat. No. 5,208,630, U.S. Pat. No. 5,385,803, and U.S. Pat. No. 5,554,480, each incorporated herein by reference. Still other pre- and post-marking treatments include substrate or surface texture coatings (e.g. to create embossing effects, to simulate an arbitrarily rough or smooth substrate), materials designed to have a physical or chemical reaction at the substrate (e.g., two materials which, when combined at the substrate, cure or otherwise cause a reaction to affix the marking material to the substrate), etc. It should be noted, however, that references herein to apparatus and methods for transporting, metering, containing, etc. marking material should be equally applicable to pre- and post-marking treatment material (and in general, to other non-marking material) unless otherwise noted or as may be apparent to one skilled in the art.

The Aerosol or Fluidized Bed

When employing a marking material having an appropriately sized and shaped particle, with a proper plasticity, packing density, magnetization, etc., the frictional and other binding forces between the particles may be sufficiently reduced by a disruption (i.e., due to a gas such as the propellant passing through marking material) such that the marking material takes on certain fluid-like, or even aerosol properties in the area of disruption. (See Fuchs, "The Mechanics of Aerosols", §58, pp. 367–373 (Pergamon Press, 1964), incorporated herein by reference, for specifics on the parameters for creating fluidization.) By providing an aerosol or fluidized bed in the manner described herein, the marking material is made to flow evenly and easily. Accurate spot size, position, color, etc., are thereby obtained.

Vibration and Gas Driven Sources

Figure 9:
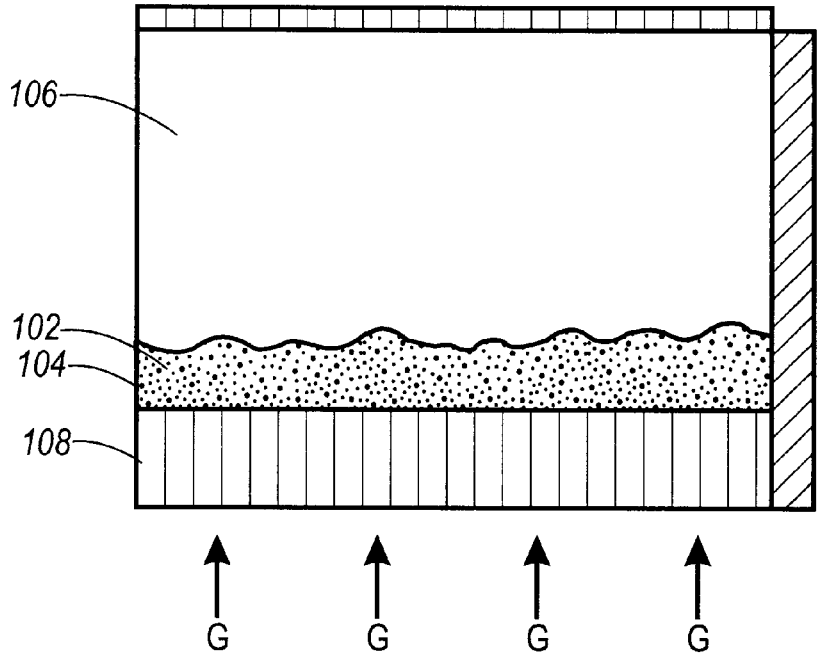
FIGS. 9–12 are cross sectional views of a marking material chamber according to one embodiment of the present invention for generation of a fluidized bed or aerosol.

With reference to FIGS. 9–12, generating an aerosol source requires that particulates 102 resting in a bed 104 be lifted out of bed 104 and into the space 106 above. This can be achieved by flowing gas G (such as air or nitrogen) through a dispersive element 108 into the bottom of bed 104. This is shown in FIG. 9. Dispersive element 108 may take the form of a glass frit, a narrow weave, wire mesh (10 $\mu$m wide openings), or other similar structure.

Figure 10:
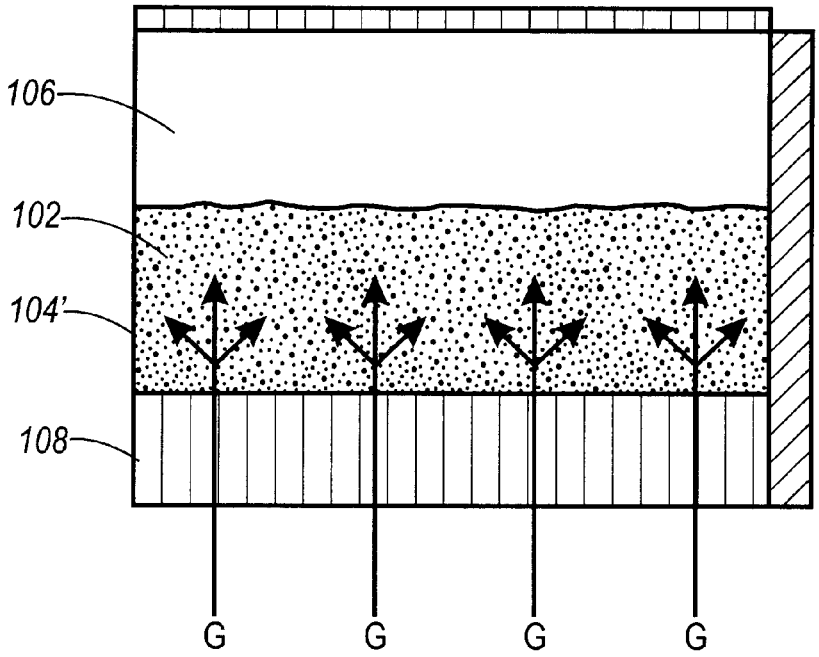

With reference now to FIG. 10, in the ideal case (i.e. for non-interacting particulates) the gas disperses homogeneously between the particulates 102, which once the applied air pressure exceeds the weight of the bed 104, moves easily within the pile (like molecules in a liquid). In this case, there is a well-defined interface between the fluidized bed 104 and the region above the bed 106, and few particulates escape the now fluidized bed 104' to form an aerosol.

By increasing the air flow through the bed 104', the instability of the fluidized bed 104' increases, and eventually a boiling state is achieved, in which air bubbles rise from the bottom of the bed and collapse at the top, ejecting large amounts of particulates. (Not shown).

Figure 11:
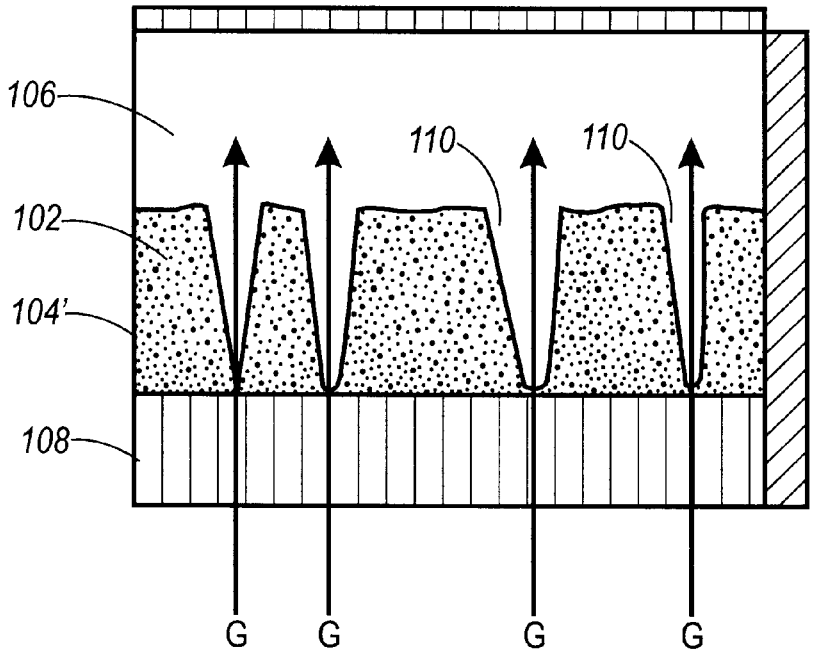

With reference now to FIG. 11, if the particles interact with (attract) each other (which is typical for micron-sized particulates such as toner particles, where adhesive forces due to Van-der-Waals interactions become dominant) the fluidization mechanism is no longer ideal. Instead, the gas entering into bed 104' seeks the path of least resistance, forming a finite number of so-called blowholes or gaps 110. Initially, some particulates are ejected through blowholes 110 and into the space 106 above the bed. But after some time an equilibrium state is achieved with well-defined blowholes 110 in an otherwise compact bed of particulates 104'.

Figure 12:
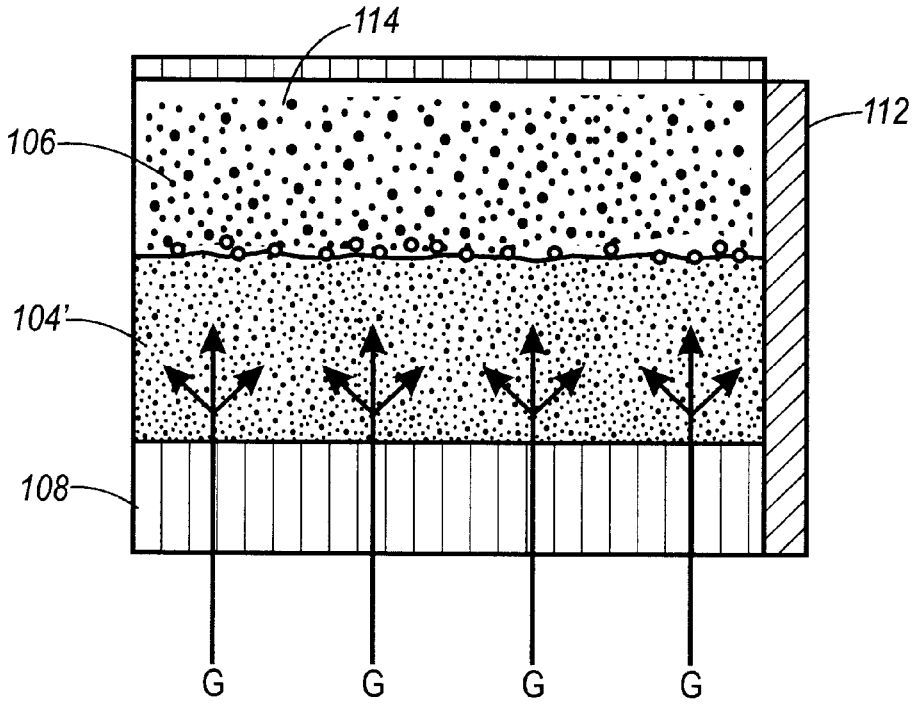

With reference now to FIG. 12, we have discovered that blowholes 110 may be destabilized by applying sonic/ultrasonic vibrations to the bed 104' by mechanical or electromechanical means 112, such as acoustic speakers or piezoelectric transducers at frequencies from 1 Hz–30 kHz. The vibrations lead to a collapse of the walls blowholes 110 in the particulate bed 104', creating loose particulates 114 which are blown into the space 106 above bed 104'.

As a result, the surface of the working particulate bed again has the appearance of boiling. Depending on the "flow quality" of the particulates (i.e., how well the particles adhere to each other and to the container walls) one of the above methods (boiling fluidized bed or destabilized blowholes), or a combination of both, are necessary to generate a well-defined aerosol from bed of particulates.

Because the boiling of the particulates bed has been found to be caused by the continual creation and destruction of gaps or blowholes in the particulates bed, other designs are clearly possible. One concept consists of replacing the dispersive element 108 with a series of small openings formed for example, by glass capillaries with diameters of 100 $\mu$m or smaller. By using individual small scale gas sources, the first two steps in the creation of an aerosol (shown in FIGS. 9 and 10) are skipped. The blow holes form immediately due to the high gas velocity at the exit of the capillaries. The holes are subsequently collapsed by sonic/ultrasonic vibration generated, for example by a piezoelectric actuator. The advantage of this scheme is that the number and uniformity of the regions of the bed generating aerosol particulates can be controlled by varying the number, distribution, and diameter of the capillaries used.

Figure 13:
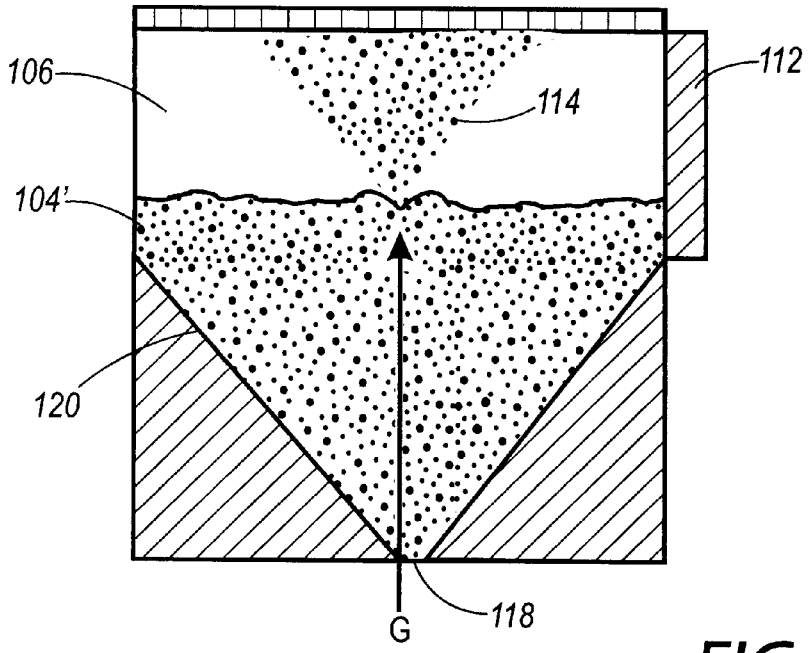
FIG. 13 is a cross sectional view of a marking material chamber according to an alternate embodiment of the present invention for generation of a fluidized bed or aerosol.

Another scheme involves the creation of a particulates bed in the shape of a funnel, as shown in illustrated in FIG. 13. Gas is supplied to a single small hole 118 at the base of a funnel 120. Particulates can continuously slide into the high velocity gas flow at the hole 118, aided by sonic/ultrasonic vibration (with aid of means 112) and gravity. Particulates are then ejected into the space 106 above the particulates bed 104' in a continuous manner.

Vibration/Mechanically-Driven Sources

For well flowing particulates, use of sonic/ultrasonic vibration can sufficiently agitate the particulates bed such that particulates are moved from the surface of the bed, into the space above the particulates bed, creating an aerosol. Experiments have shown that this process is enhanced in the particulates beds with the funnel shaped container. The disturbances in the particulates bed occur not only near the piezoelectric actuator but in the center of the particulates bed.

Figure 14:
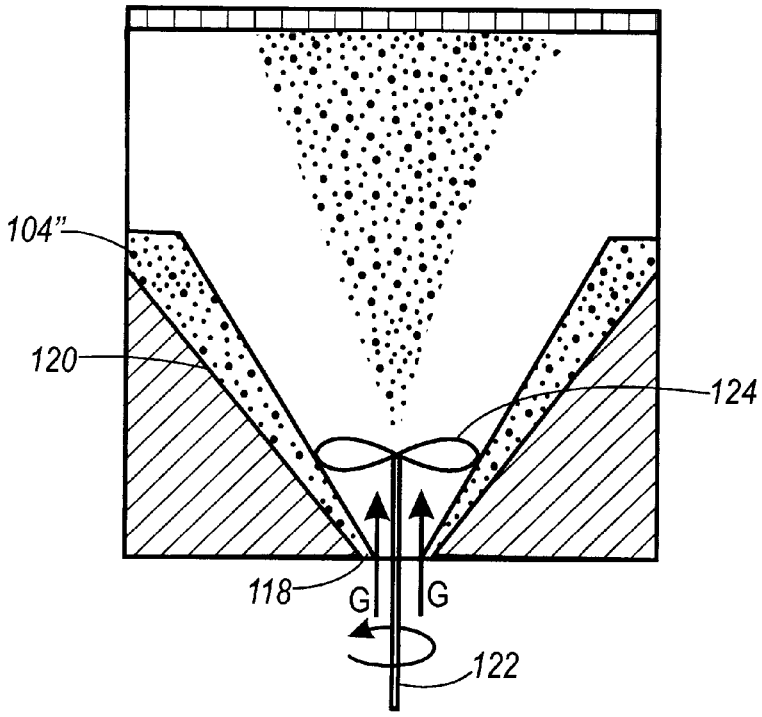
FIG. 14 is a cross sectional view of a marking material chamber according to yet another embodiment of the present invention for generation of a fluidized bed or aerosol.

A mechanically driven source is illustrated in FIG. 14. It consists basically of the funnel structure shown in FIG. 13, with the addition of an internal agitator 122, such as a motor-driven propeller. Particulates are ejected above the bed 104" by the propeller assembly 124, which also pulls gas in from the inlet 118 at the bottom of funnel structure 120. The gas pulled in helps eject particulates from the bed 104" and keep them suspended in aerosol form.

Vibration-driven particulates, such as those shown discussed above, exist in a mobile state. Particulates from such a mobile bed can be supplied to the inlets of channels of a ballistic aerosol marking device, using gravity and gas flow as driving forces. The inlets would reside under the opening in the marking material container. There can be net gas flow into or out of the inlets, depending on the design of the channels in question. The pressure in the particulates chamber can be controlled using the gas inlet on the top of the particulates container. The pressure can be adjusted to create net gas flow in the desired direction.

It will now be appreciated that various embodiments of a ballistic aerosol marking apparatus, and specifically mechanisms for the creation of a fluidized bed and/or aerosol, have been disclosed herein. These embodiments encompass a complete device for applying a single marking material, one-pass full-color marking material, applying a material not visible to the unaided eye, applying a pre-marking treatment material, a post-marking treatment material, etc., with the ability to tailor the position of the marking material in or at the ports to address considerations of material quantity and quality control, charge requirements, etc. However, it should also be appreciated that the description herein is merely illustrative, and should not be read to limit the scope of the invention nor the claims hereof.

What is claimed is:

1. A marking apparatus, comprising:

a marking material reservoir with dry particulate marking material disposed within, said marking material reservoir having a vibration source associate therewith and operable to subject at least a portion of the marking material disposed within said marking material reservoir to a mechanical vibration to assist in creation of a fluidized bed of the marking material;

a structure having formed therein a channel for receiving marking material from said marking material reservoir;

a port communicatively connecting said marking material reservoir and said channel so as to allow some of the marking material to travel from said marking material reservoir to said channel; a metering device associated with said port, the metering device to selectively introduce some of the marking material from said reservoir into said channel; and an interior surface of said port having formed therein a plurality of capillaries, each capillary having an mean diameter of 100 $\mu$m or smaller, and arranged to introduce a fluid through said capillaries in said interior surface of said port into said marking material reservoir, the plurality of capillaries to provide a plurality of fluid sources into said marking material reservoir and assist in the creation of a fluidized bed of marking material.

2. The marking apparatus of claim 1, wherein said vibration source is a transducer.

3. The marking apparatus of claim 2, wherein said vibration source is operated between 1 Hz and 30 kHz.

4. The marking apparatus of claim 1, wherein said plurality of capillaries are arranged in a non-uniform pattern across said interior surface of said port to produce the fluidized bed of a predetermined profile.

5. The marking apparatus of claim 4, wherein said non-uniform pattern is a non-uniformity of capillary diameter.

6. The marking apparatus of claim 1, further comprising:

a interior surface having formed therein at least one fluid source, said fluid source having a proximal end and a distal end, said proximal end having a first diameter, said distal end having a second diameter greater than said first diameter.

7. The marking apparatus of claim 6, wherein said fluid source has a funnel-shaped cross-sectional profile.

8. The marking apparatus of claim 6, further comprising a propeller which may rotate around a shaft which is roughly coaxial with said fluid source.

9. The marking apparatus of claim 8, wherein said propeller is located in a region partway between said proximal end and said distal end.

10. A removably replaceable cartridge for use in a marking apparatus, comprising:

a marking material reservoir with dry particulate marking material disposed within, said marking material reservoir having a vibration source associate therewith and operable to subject at least a portion of the marking material disposed within to a mechanical vibration to assist in creation of a fluidized bed of marking material therein;

a port located in said marking material reservoir for communicatively connecting to an operable portion of the marking apparatus; and an interior surface of said port having formed therein a plurality of capillaries, each capillary having a mean diameter of 100 $\mu$m or smaller, and arranged to introduce a fluid into said marking material reservoir, the plurality of capillaries to provide a plurality of fluid sources into said marking material reservoir and assist in the creation of a fluidized bed of marking material.

11. The cartridge of claim 10, wherein said vibration source is a transducer.

12. The cartridge of claim 10, wherein said plurality of capillaries are arranged in a non-uniform pattern across said interior surface of said port to produce the fluidized bed of predetermined profile.

13. The cartridge of claim 12, wherein said non-uniform pattern is a non-uniformity of capillary diameter.

14. The cartridge of claim 10, further comprising:

a interior surface having formed therein at least one fluid source, said fluid source having a proximal end and a distal end, said proximal end having a first diameter, said distal end having a second diameter greater than said first diameter.

15. The cartridge of claim 14, wherein said fluid source has a funnel-shaped cross-sectional profile.

16. The cartridge of claim 10 wherein the marking material reservoir is subjected to the mechanical vibration to assist in creation of the fluidized bed of marking material therein.

* * * * *